United States Patent [19]

Takahashi et al.

[11] Patent Number: 4,705,004

[45] Date of Patent: Nov. 10, 1987

[54] FUEL INJECTION CONTROL SYSTEM FOR INTERNAL COMBUSTION ENGINE

[75] Inventors: Hiroshi Takahashi; Masanobu Tamura, both of Toyota; Kunihiko Sato, Okazaki, all of Japan

[73] Assignee: Toyota Jidosha Kabushiki Kaisha, Aichi, Japan

[21] Appl. No.: 906,088

[22] Filed: Sep. 11, 1986

[30] Foreign Application Priority Data

Sep. 12, 1985 [JP] Japan ..... 60-200489
Sep. 13, 1985 [JP] Japan ..... 60-201830

[51] Int. Cl.[4] ..... F02D 41/06

[52] U.S. Cl. ..... 123/491; 123/179 L; 364/431.1

[58] Field of Search ..... 123/179 G, 179 L, 491, 123/478; 364/431.1

[56] References Cited

U.S. PATENT DOCUMENTS 4,344,392 8/1982 Iijima et al. ..... 123/179 G

FOREIGN PATENT DOCUMENTS 151128 11/1980 Japan ..... 123/491
229021 12/1984 Japan ..... 123/491
60-22045 2/1985 Japan .
60-35142 2/1985 Japan .
2146800 4/1985 United Kingdom ..... 123/491

*Primary Examiner*—Tony M. Argenbright
*Attorney, Agent, or Firm*—Cushman, Darby & Cushman

[57] ABSTRACT

A fuel injection control system for an internal combustion engine including: a cold start injection valve provided inside an intake pipe for performing fuel injection on cold starts; a switch for controlling energization of the cold start injection valve; a starter drive state detector for judging if a starter is being driven; a clock for detecting, by the starter drive state detector, a change of the starter from a nonoperating state to an operating state and for counting time elapsed from the detected change; and start controller which designates a starting fuel injection when the elapsed time counted by the clock is a first predetermined period or more and which prohibits the starting fuel injection when the elapsed time is a second predetermined period or more greater than the first predetermined period.

13 Claims, 20 Drawing Figures

FUEL INJECTION CONTROL SYSTEM FOR INTERNAL COMBUSTION ENGINE

BACKGROUND OF THE INVENTION

1. Field of the Invention

The present invention relates to a fuel injection control system for an internal combustion engine, more particularly to an electronic fuel injection control system which controls the fuel injection timing and fuel injection time of a cold start injection valve for improvement of the cold start characteristics.

2. Description of the Related Art

Internal combustion engines which use computers for fuel injection control are provided with cold start injection valves, apart from the main fuel injection valves, to improve the engine starting characteristics on cold days (at low temperatures). Such engines have one main fuel injection valve for each of the cylinders, but only a signal cold start injection valve-generally in the surge tank. The injection time of this cold start injection valve is controlled based on the temperature of the engine cooling water and the energization period of the heat coils. In improving low temperature starting characteristics, it is natural to use a fuel with good atomization, but unless the fuel injection timing and fuel injection time are sufficiently controlled, the starting characteristics will only deteriorate. Further, fuel adhering to the inside wall of the intake pipe will increase the amount of hydrocarbons (HC) and carbon monoxide (CO) in the exhaust gas and thus give result in poorer emission. Use of a fuel with poor atomization (coarse fuel) or smoking of the spark plug due to excess fuel can result in poorer starting characteristics and the emission.

SUMMARY OF THE INVENTION

The present invention has as its object the provision of an electronic fuel injection control system for an internal combustion engine which controls the fuel injection timing and the fuel injection time of the cold start injection valve used for cold periods so as to prevent increased content of hydrocarbons and carbon monoxide in the exhaust gas caused by fuel adhering to the inner walls of the intake pipe and so as to prevent deterioration of the starting characteristics caused by excess fuel-included smoking of the spark plugs and coarse fuel, thus improving the emission.

To achieve this object, according to the present invention, there is provided a fuel injection control system for an internal combustion engine comprising: a cold start injection valve provided inside an intake pipe for performing fuel injection on cold starts; a switch means for controlling energization of the cold start injection valve; a starter drive state detection means for judging if a starter is being driven; a clock means for detecting, by the starter drive state detection means, a change of the starter from a non-operating state to an operating state and for counting time elapsed from the detected change; and a start control means which designates a starting fuel injection when the elapsed time counted by the clock means is a first predetermined period or more and which prohibits the starting fuel injection when the elapsed time is a second predetermined period or more greater than the first predetermined period.

BRIEF DESCRIPTION OF THE DRAWINGS

The present invention will be explained in more detail with reference to the figures, in which.

DESCRIPTION OF THE PREFERRED EMBODIMENTS

Before describing the preferred embodiments of the invention, an explanation will be given of a conventional technique.

Figure 1:
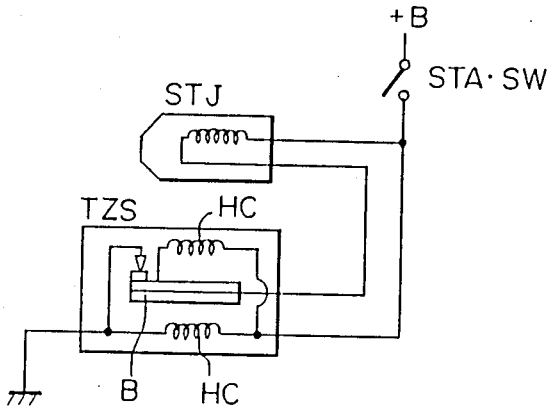
Fig. 1 PRIOR ART
FIG. 1 is a circuit diagram of a prior art cold start injection valve (STJ) and timer (TZS)

As shown in FIG. 1, in the prior art, the drive of the cold start fuel injection valve used for cold starts is controlled by a mechanical type timer, i.e., a starter injection time switch (TZS), provided with a heater-equipped bimetal. When the starter switch (STA SW) is turned on, the bimetal contacts close and the cold start injection valve is energized, whereupon the cold start injection valve begins fuel injection. When the temperature of the engine cooling water around the bimetal B reaches the set temperature of the bimetal of the time switch, the contacts of the bimetal B open, the cold start injection valve is not longer energized, and injection by the cold start injection valve is stopped. When the temperature of the engine cooling water is less than the set temperature, heat generated by heat coils HC causes the contacts of the bimetal B to open after the elapse of a predetermined time so that the cold start injection valve is not energized for more than the predetermined time.

Figure 2:
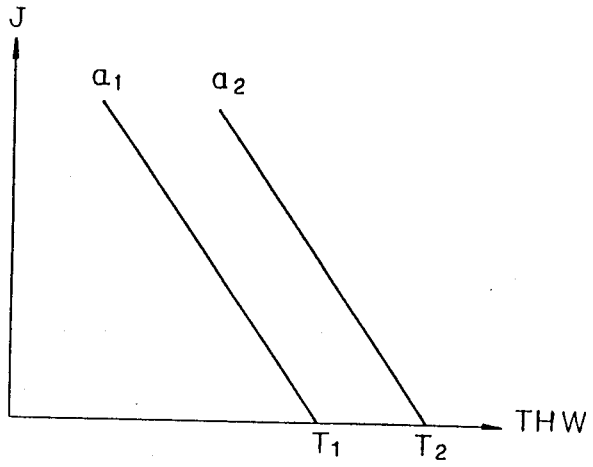
Fig. 2 PRIOR ART
FIG. 2 is a graph of the relationship between the drive time of the start injection valve and engine cooling water temperature in the prior art.

In this way, the maximum drive time (J) of the time switch is set by the set temperature $T_1$ or $T_2$ of the time switch according to the straight line relationship shown by $T_1$-$a_1$ or $T_2$-$a_2$ of FIG. 2. In this case, with either set temperature, the starter switch (STA SW) of the cold start injection valve can be turned off to stop the drive of the cold start injection valve in a time shorter than the drive time of the time switch.

Figure 3:
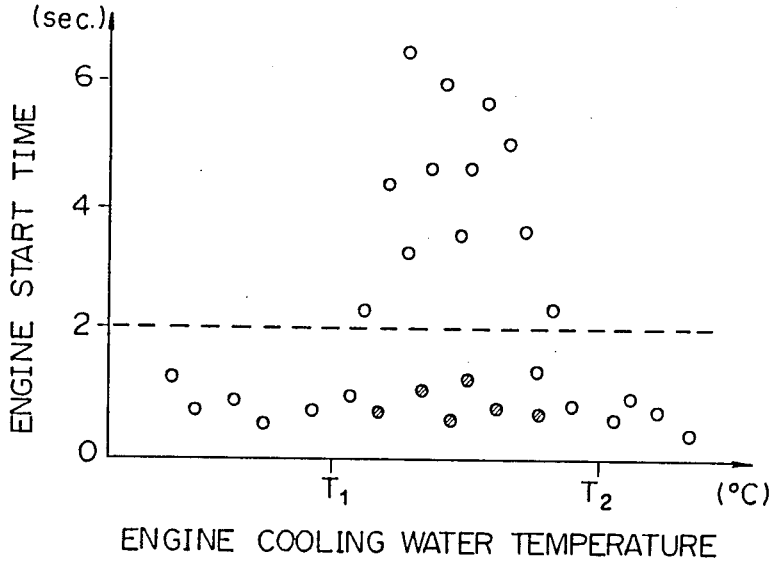
FIG. 3 is a graph of the relationship between the engine start time and engine cooling water temperature.

The prior art mechanical timer (TZS) and its control system shown in FIG. 1 and FIG. 2 suffer from the following problems. As shown in FIG. 3, if the engine cooling water temperature is set to $T_1$, for example, 20° C., naturally the cold start injection valve will not be driven above $T_1$. However, as shown by the white dots, when a coarse fuel with a low lead vapor pressure is used, it takes time until the engine starts up. That is, the engine starting characteristics deteriorate considerably and the starting time, which would be 1 to 2 seconds with use of the cold start injection valve under $T_1$, becomes 5 to 6 seconds. Further, in the summer months, when the outside temperature is high, the engine cooling water may remain at the temperature of $T_1$ or more for long periods. Therefore, the cold start injection valve will not be driven and the injection port can become clogged with solidified fuel.

As one means to overcome these problems, consideration may be given to raising the set temperature of the cold start injection valve to $T_2$. In this case, the cold start injection valve is not driven under $T_2$, so, as shown by the block dots, the engine starting time becomes about 1.5 seconds—a considerable improvement and a level which poses no problems. If the starter switch is turned on even after the starting, however, the cold start injection valve will be driven for the maximum drive time of the time switch and wasteful fuel injection will result. Even with normal fuel, therefore, hydrocarbons, carbon monoxide, and the like will be emitted during startup, i.e., poorer emission will result.

Further, there is the problem that, in this case, since fuel injection by the cold start injection valve is performed before the engine begins cranking and a flow of intake air is created in the intake pipe, the fuel adheres to the walls of the intake pipe and the rate of atomization decreases, whereby the emission (HC, CO) deteriorates.

Japanese Unexamined patent publication (Kokai) No. 60-22045 discloses the parallel drive of a cold start injection valve using a time switch and computer. The cold start injection valve is driven by the computer for an extremely short time (20 msec). This is for the sole purpose of preventing clogging of the injection port of the cold start injection valve. No mention is made of a cold start injection valve drive time enabling prevention of deterioration of starting characteristics due to coarse fuel at a temperature range higher than the set temperature $T_1$ of the time switch.

A fuel injection control system for an internal combustion engine according to the present invention will now be described.

Figure 4:
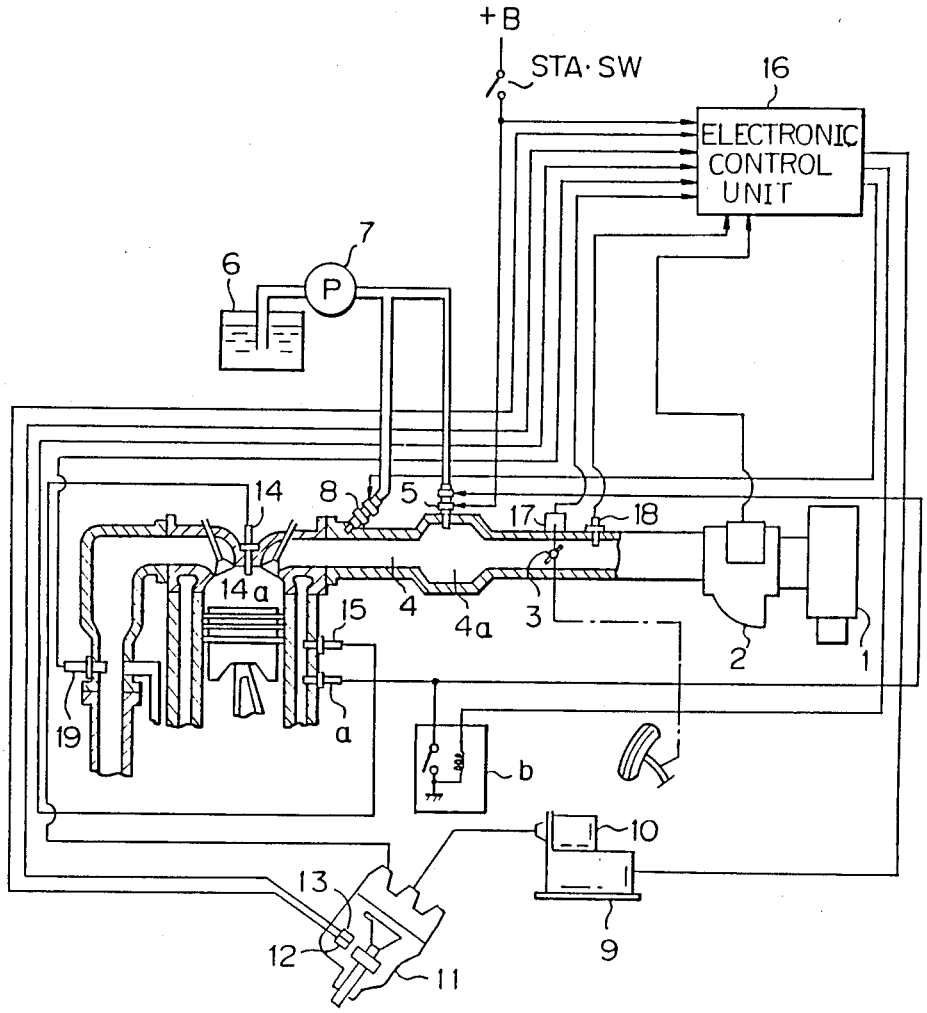
FIG. 4 is a view of an engine to which the electronic fuel injection control system of the present invention is applied and its peripheral equipment.

FIG. 4 is a view of an engine to which the electronic fuel injection control system of the present invention is applied and its peripheral equipment. In FIG. 4, reference numeral 1 is an air cleaner, 2 an air flow meter, 3 a throttle valve, 4 an intake passageway, 4*a* a surge tank, 5 a cold start injection valve, 6 a fuel tank, 7 a fuel pump, 8 a fuel injection valve, 9 an ignition coil, 10 an igniter, 11 a distributor, 12 a cylinder discrimination sensor, 13 a rotational angle sensor, 14 a spark plug, 14*a* a combustion chamber, 15 a water temperature sensor, a a first control switch, 16 an electronic control unit, 17 a throttle valve opening sensor, 18 an intake air sensor, 19 an oxygen sensor, and b a second control switch.

In this construction, the cold start injection valve (STJ) 5 provided in the surge tank 4*a* of the intake passageway 4 is controlled as to its drive timing and time by the first control switch a provided near the water temperature sensor 15 of the cylinder block of the engine body and by the second control switch b controlled in ON/OFF state by the electronic control unit 16, which serves as a control means. The rotational angle sensor 13 outputs a pulse signal proportional to the rotational speed of the engine.

Figure 5:
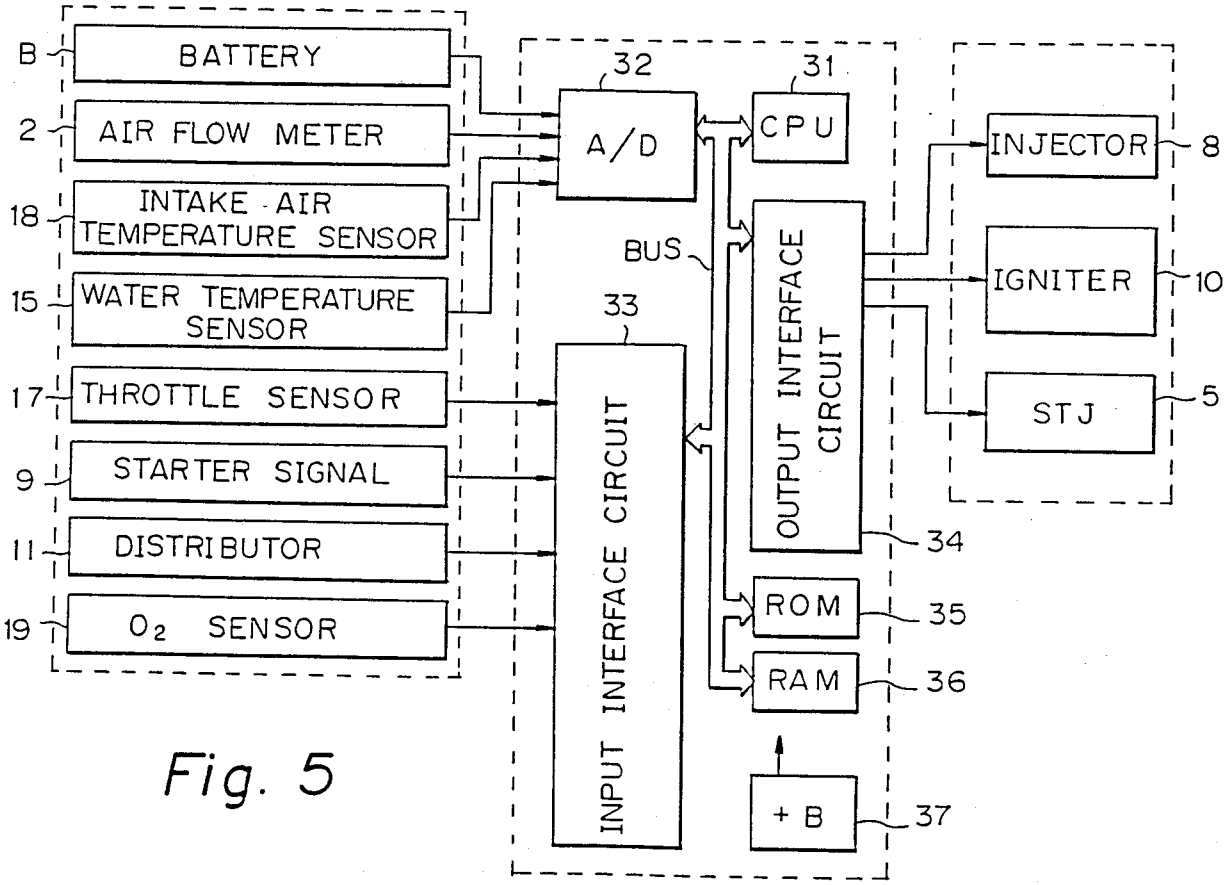
FIG. 5 is a detailed block diagram of the fuel injection control system of FIG. 4.

FIG. 5 is a detailed block diagram of the electronic control system (ECU) of FIG. 4. In FIG. 5, the ECU 16 provided with a bus line BUS for connection of other elements, a central processing unit (CPU) 31, comprised of a microprocessor, an analog-to-digital (A/D) converter 32 for converting analog signals from the sensors to digital signals, an input interface circuit 33, an output interface circuit 34, an read-only memory (ROM) 35, a random-access memory (RAM) 36, and a constant voltage power source 37.

In this construction, the battery voltage (+B), the air flow output, the intake air temperature (THA) output, and the engine water temperature sensor output (THW) are converted from analog to digital signals by the analog-to-digital converter 32 and the starter signal and distributor signal (engine rotational speed) are input to the input interface circuit 33. The central processing unit 31 performs processing based on these signals as shown by the later-mentioned control flow and provided output to the fuel injection valve 8, igniter 10, and cold start injection valve 5 to drive the same.

FIGS. 6 to 12 show the basic structure and various embodiments of the control portion of the cold start injection valve of an electronic fuel injection control system according to the present invention.

Figure 6:
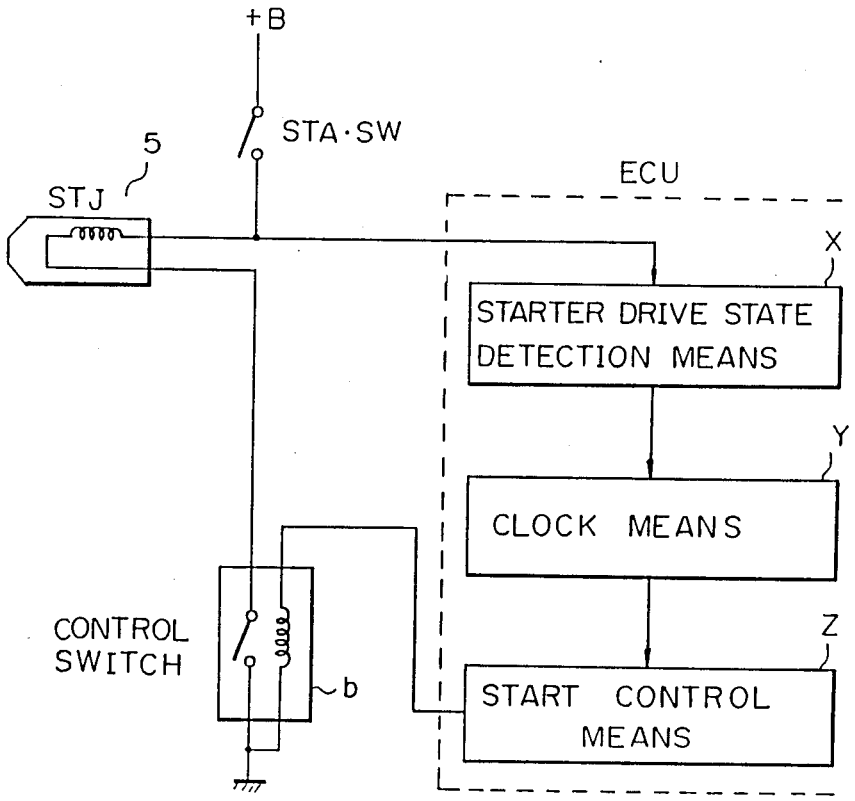
FIGS. 6 to 12 are block diagrams of the control portion of the cold start injection valve of FIG. 4 for explaining various embodiments of the present invention.

FIG. 6 shows the basic structure of the control portion of the cold start injection valve of a fuel injection control system of an internal combustion engine according to the present invention. As shown in the figure, this portion includes a starter drive state detection means X for judging if the starter is being driven; a clock means Y for detection, by the starter drive state detection means, a change of the starter from a non-operating state to an operating state and for counting time elapsed from that detected change; and a start control means Z which designates a starting fuel injection when the elapsed time counted by the clock means is a first predetermined period or more and which prohibits the starting fuel injection when the elapsed time is a second predetermined period or more greater than the first predetermined period. Various embodiments will be explained below with reference to the other figures.

Figure 7:
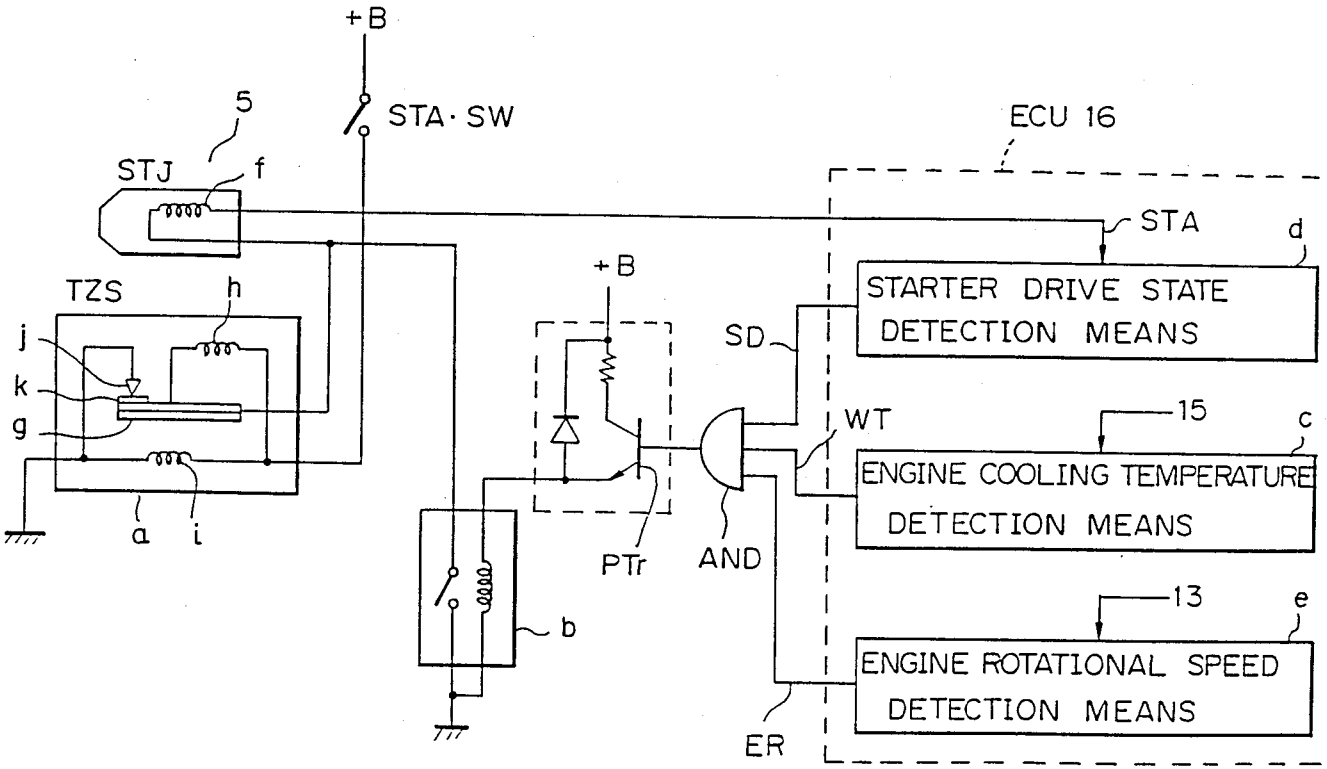

The cold start injection valve control portion of the fuel injection control system of the present invention shown in FIG. 7 includes a first control switch a, a second control switch b, and, in the ECU, an engine cooling water temperature detection means c, a starter drive state detection means d, and an engine rotational speed detection means e. The cold start injection valve is provided with a solenoid f which controls the valve operation. The solenoid f is connected as illustrated to the first control switch a and the second control switch b. The first control switch a is comprised of a bimetal g and heat coils h and i and has contacts j and k. The bimetal g is designed so that the contacts j and k close when the engine cooling water temperature is less than a first set temperature $T_1$. In the starting period when the contacts j and k close, if the starter switch (STA, SW) is turned on, current flows to the solenoid f of the cold start injection valve and the cold start injection valve opens and begins fuel injection. Further, even below $T_1$, the bimetal is heated by the heat coils h and i, so the contacts will initially close, but will open after the predetermined time so as to cut off current to the solenoid f and stop the fuel injection of the cold start injection valve. On the other hand, if the engine cooling water temperature becomes higher than even the set temperature $T_1$, the contacts j and k will open and the cold start injection valve will be driven under independent control by the second control switch b as explained later.

The second control switch b is connected in parallel to the first control switch a and controls the operation of the cold start injection valve by a later-mentioned control flow independent from the first control switch a.

Regarding the functional means c to e provided in the ECU 16, the engine cooling water temperature detection means c outputs a water temperature detection signal WT when the temperature of the engine cooling water is in a range higher than the set temperature $T_1$ and lower than the set temperature $T_2$.

The starter drive state detection means d detects whether the starter switch for the starting motor drive is in an ON state and, when in an ON state, outputs a starter drive detection signal SD.

The engine rotational speed detection means e outputs an engine rotational speed detection signal ER when the engine is in a predetermined range of rotational speed.

When the water temperature detection signal WT, the starter drive detection signal SD, and the engine rotational speed detection signal ER all match, the AND gate opens and power transistor PTr turns on, so a current flows through the coil of the second control switch b, the switch b turns on, and the cold start injection valve injects fuel. An elapsed time detection means which detects the elapse of a predetermined time after the starter switch enters the ON state is further provided. The second control switch is on up until that elapsed time so as to drive the cold start injection valve.

Figure 8:
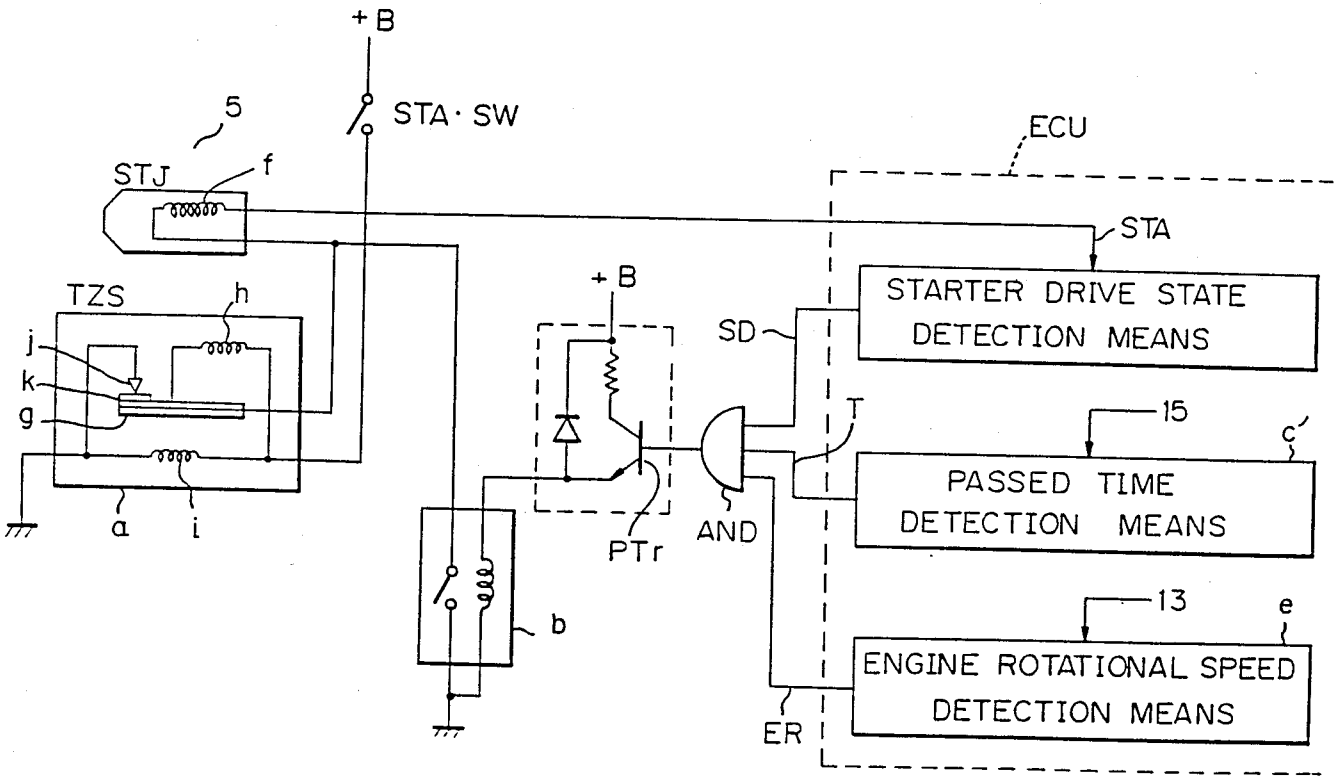

FIG. 8 shows a modification of the portion of FIG. 7. Instead of the engine cooling water temperature detection means c of FIG. 7, an elapsed time detection means c' which detects the ON time of the starter switch is provided. The other structural elements are the same as those of FIG. 6, so an explanation thereof will be omitted.

In FIG. 8, the cold start injection valve control portion of the fuel injection control system of the present invention includes a first control switch a, a second control switch b, and, in the ECU, an elapsed time detection means c' for the ON state of the starter switch, a starter drive state detection means d, and an engine rotational speed detection means e.

The elapsed time detection means c' detects the elapse of a predetermined time from when the starter switch (STA SW) turns on and outputs an elapsed time detection signal T.

When the elapsed time detection signal T, the starter drive detection signal SD, and the engine rotational speed detection signal ER all match, the AND gate opens and power transistor PTr turns on, so the detection means c' to d are controlled by the later-mentioned control pattern, whereby the timing by which the second control switch turns on is controlled and the drive starting timing of the cold start injection valve is controlled.

There may further be added an engine cooling water temperature detection means as shown in FIG. 7 for outputting a water temperature detection signal when the temperature of the engine cooling water is in a range higher than the set temperature $T_1$ and lower than the set temperature $T_2$ so that the second control switch is controlled as to its ON timing within that set temperature range to open the cold start injection valve.

Figure 9:
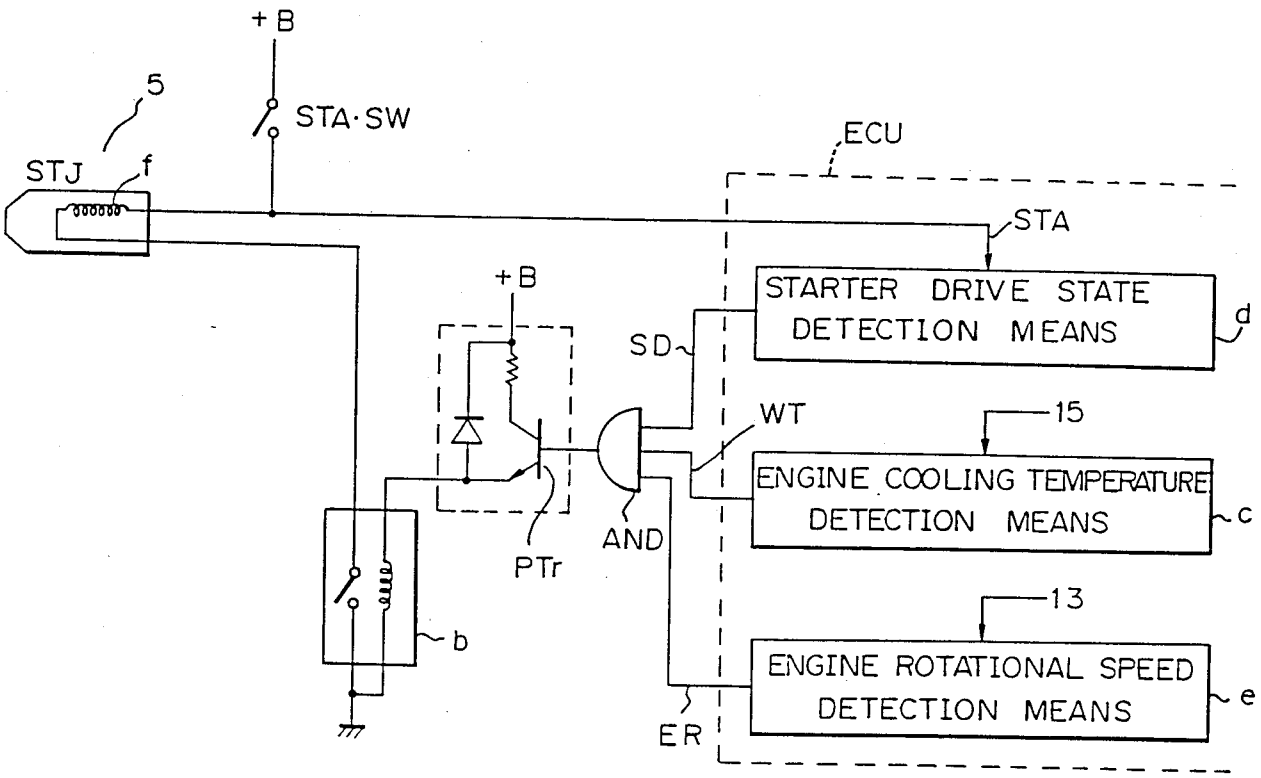

FIG. 9 shows another example of the construction of the present invention. As clear from the figure, the first control switch used in the embodiment of FIG. 7 is eliminated and the drive for operating the cold start injection valve is performed by just the second control switch b. The ON/OFF state of the control switch b is controlled based on the detection signals from the engine cooling water temperature detection means c, the starter drive state detection means d, and the engine rotational speed detection means e, just as in the embodiment of FIG. 7.

Figure 10:
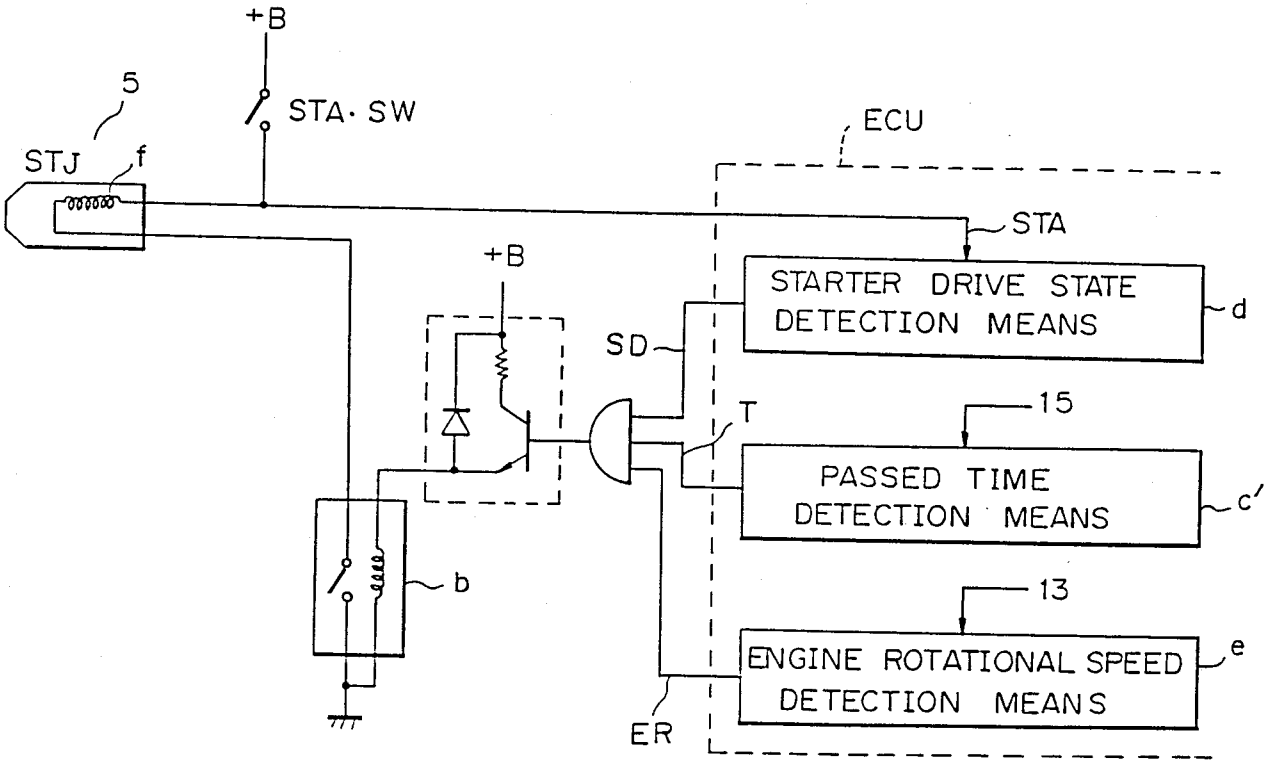

FIG. 10 shows a modification of FIG. 9. As clear from the figure, the first control switch a used in the embodiment of FIG. 8 is eliminated and the drive for operating the cold start injection valve is performed by just the second control switch b. The ON/OFF state of the control switch b is controlled based on the detection signals from the elapsed time detection means c', the starter drive state detection means d, and the engine rotational speed detection means e, just as in the embodiment of FIG. 8. In this case, judgement as to the engine cooling water temperature (THW) is performed by the set temperatures $T_1$ and $T_2$ by another means.

Figure 11:
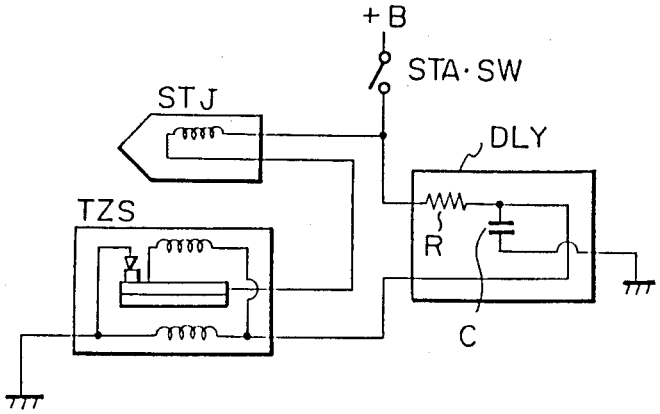
Figure 12:
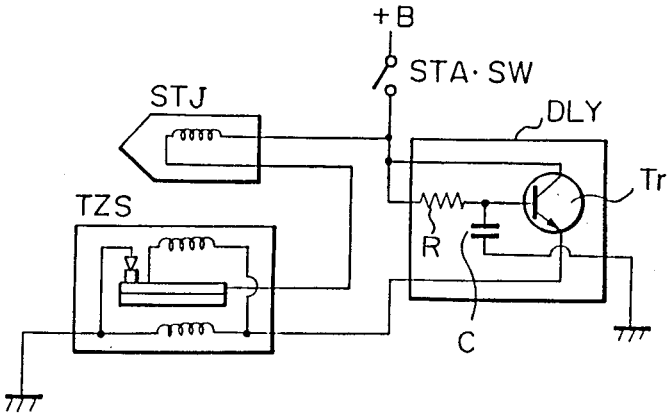

FIGS. 11 and 12 show a further embodiment of the present invention. In this embodiment, the drive timing of the cold start injection valve is delayed by a predetermined time after the starter switch STA SW is turned on, through, for example, the provision of a delay circuit DLY comprised of a resistor R and capacitor, shown in FIG. 11, between the time switch TZS and starter switch STA SW. Further, as shown in FIG. 12, a transistor Tr is added to lower the load on the resistor R and raise the endurance. With this construction, the predetermined delay time, for example, 100 msec, can be set by appropriate selection of the time constant RC. Use of this circuit enables simplification of the construction and reduction of costs.

Figure 13:
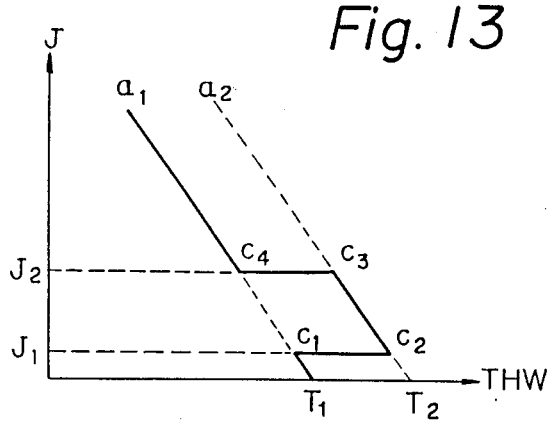
FIG. 13 is a graph of the relationship between the drive time of the cold start injection valve and engine cooling water temperature in an embodiment of the present invention.

FIG. 13 is a graph of the relationship between the cold start injection valve drive time (J) and engine cooling water temperature (THW) of a fuel injection control system according to the present invention. In FIG. 13, the straight line $T_1$-$a_1$ indicates the case where the set temperature of the time switch is $T_1$. This is equivalent to drive of the cold start injection valve by just the time switch TZS shown in FIG. 12. As mentioned earlier, when coarse fuel is used in the range of engine cooling water temperature higher than $T_1$ (for example, 20° C.) and where the time switch will not operate, the starting characteristics can deteriorate as shown by the white dots of FIG. 3. Even with regular fuel, excess fuel may cause deterioration of the emissions. $T_2$-$a_2$ of FIG. 13 indicates the case where the time switch set temperature is higher than $T_1$. For example, if the set temperature of the time switch TZS is made $T_2$=40° C., as clear from FIG. 3, even with coarse fuel, the starting time is less than 2 seconds and thus the starting characteristics do not deteriorate. However, in this case, during starting, if the starter switch is not turned off, the cold start injection valve will be driven along the straight line $T_2$-$a_2$ shown by the dotted line. This would result in excess fuel and deterioration of the emission at startups at normal temperatures. Therefore, in one embodiment of the present invention, the pattern of the drive time of the cold start injection valve is controlled as shown by the solid line so as to prevent deterioration of the emission due to excess fuel above the set temperature $T_1$ and to improve the starting characteristics even with use of coarse fuel. That is, the maximum drive time of the cold start injection valve is controlled to an upper limit J2 (for example, 2 seconds) by the line C3 to C4 shown by the solid line. Further, the cold start injection valve drive timing is controlled to start above the line C1 to C2 (for example, 100 msec) shown by the solid line so that the cold start injection valve is driven after an intake air flow is generated in the intake passageway.

As clear from the above explanation, the control of the cold start injection valve drive time is performed by the time switch TZS in the left range of $T_1$-$a_1$ and by the electronic control unit (ECU) 16 in the range of C1-C2-C3-C4. That is, the control of the cold start injection valve drive time according to the present invention is performed in the range $a_1$-C4-C3-C2-C1-$T_1$. Of course, even within the above range, the cold start injection valve is stopped when the start judgement rotational speed is exceeded, as mentioned later, or when the starter switch is turned off.

Figure 14:
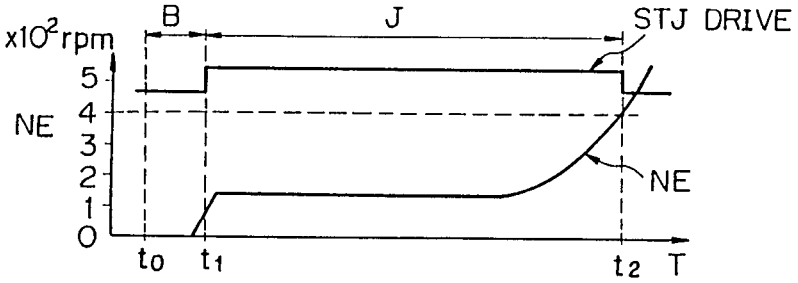
FIG. 14 is a graph of the relationship between the engine rotational speed and time elapsed in the start injection valve drive in an embodiment of the present invention.

FIG. 14 is a graph of the relationship between the elapsed time of the cold start injection valve drive and the engine rotational speed of a fuel injection control system according to the present invention. In this embodiment, above the set temperature $T_1$, the cold start injection valve is energized to start the injection after the elapse of a predetermined time B from when the starter switch is turned on i.e., the engine begins cranking, and the injection is continued for exactly a predetermined time J. In the time B, there is no flow of intake air in the intake pipe, so the cold start injection valve is not driven. A delay time B of approximately 100 msec is appropriate.

Figure 15:
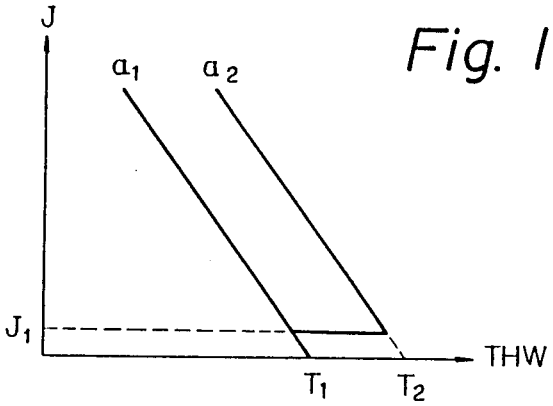
FIG. 15 is a graph of the relationship between the drive time of the start injection valve and engine cooling water temperature in another embodiment of the present invention.

FIG. 15 is a graph of the relationship between the cold start injection valve drive time J and engine cooling water temperature THW in another embodiment of the present invention. J1 corresponds to $t_1$ of FIG. 14 and is the timing at which the cold start injection valve begins to be driven. As clear from the figure, above the set temperature $T_1$, the drive start timing of the cold start injection valve is delayed by exactly J1.

Figure 16:
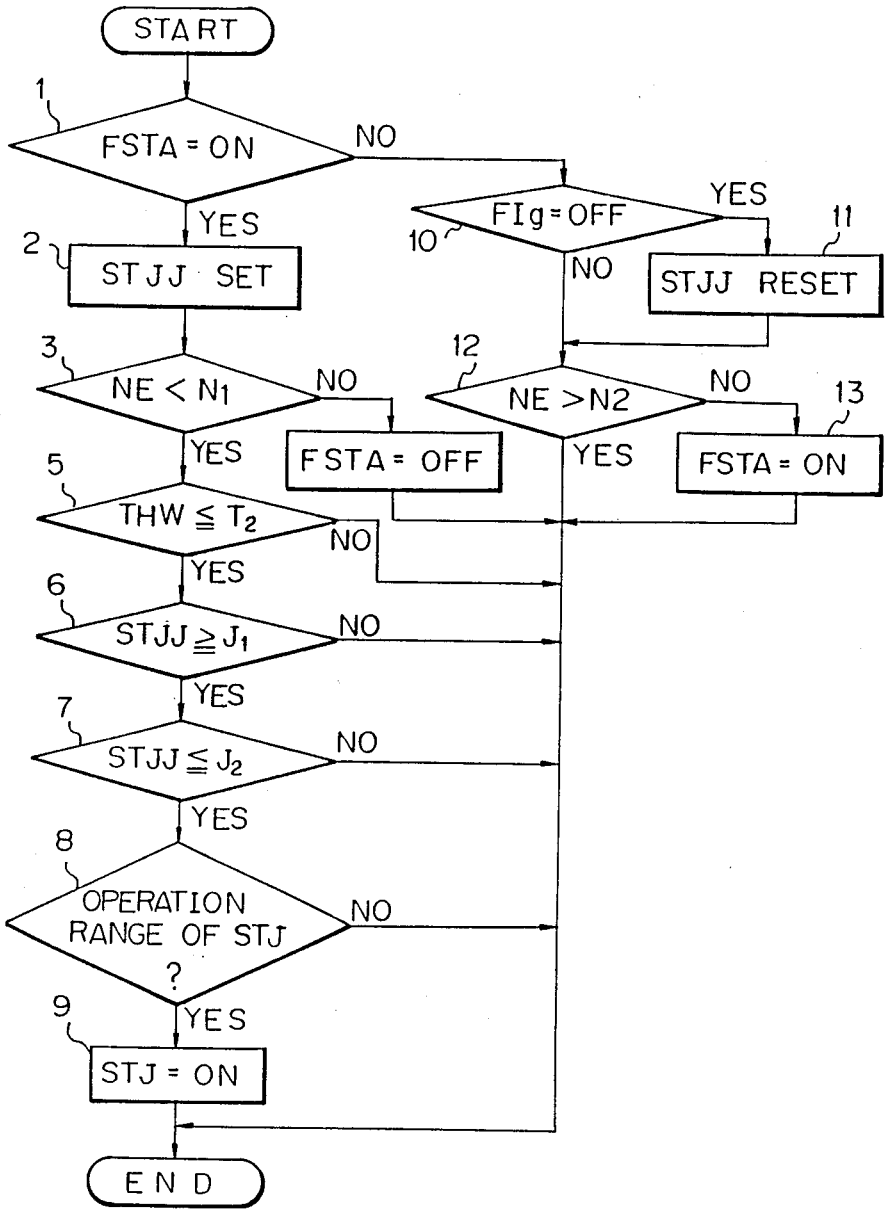
FIG. 16 is a flow chart of control of an embodiment of the present invention.

FIG. 16 is a flow chart of control of a fuel injection control system according to the present invention. Using this control flow chart, the cold start injection valve drive timing pattern of FIG. 13 can be obtained. Referring to FIG. 16, first it is judged if the flag FSTA, which indicates the starting state, is ON or OFF (step 1). When FSTA is ON, when this was the first time FSTA became ON, the cold start injection valve operation timer STJJ is set and counting begun (step 2). Next, it is judged if the engine rotational speed has exceeded a first start judgement rotational speed N1 (for example, 400 rpm) (step 3). If it has exceeded it, FSTA is turned OFF (step 4) and no control performed, ending the routine. If it has not exceeded it, it is judged if the engine cooling water temperature (THW) is below a second set temperature $T_2$ (step 5). If THW is above $T_2$, no control is performed and the routine ends. If THW is below $T_2$, next it is judged if the count of the timer STJJ is larger than J1 (step 6). Here, J1 is the time (count) up to the generation of a flow of intake air as shown by FIG. 13. When the count of the timer STJJ is larger than J1, it is next judged if it is smaller than J2 (step 7). Here, J2 is the maximum drive time (count) of cold start injection valve between the set temperature $T_1$ and $T_2$ as shown in FIG. 13. Based on the judgements of steps 5, 6, and 7, it is judged if the cold start injection valve operation range has been entered, as shown by FIG. 13 (step 8). When out of the cold start injection valve operation range, the routine ends. When in the range, the cold start injection valve is turned on (step 9). By this, to drive the cold start injection valve, the power transistor PTr shown in FIGS. 7 and 8 is turned on, the second control switch b is turned on, the cold start injection valve is driven, and fuel is injected.

On the other hand, if the starting state flag FSTA is OFF at step 1, judgement as to if the engine is in the operation state is made by judging whether the ignition flag FIg is ON or OFF (step 10). When OFF, the timer STJJ set at step 2 is reset (step 11). When ON, the same control is performed. When the ignition flag FIg is ON, it is judged if the engine rotational speed exceeds a second starting rotational speed N2 (for example, 300 rpm) (step 12). When lower than the rotational speed N2, the engine is in the starting state, so the starting state flag FSTA is turned ON (step 13). When the rotational speed exceeds N2, the routine ends.

Figure 17:
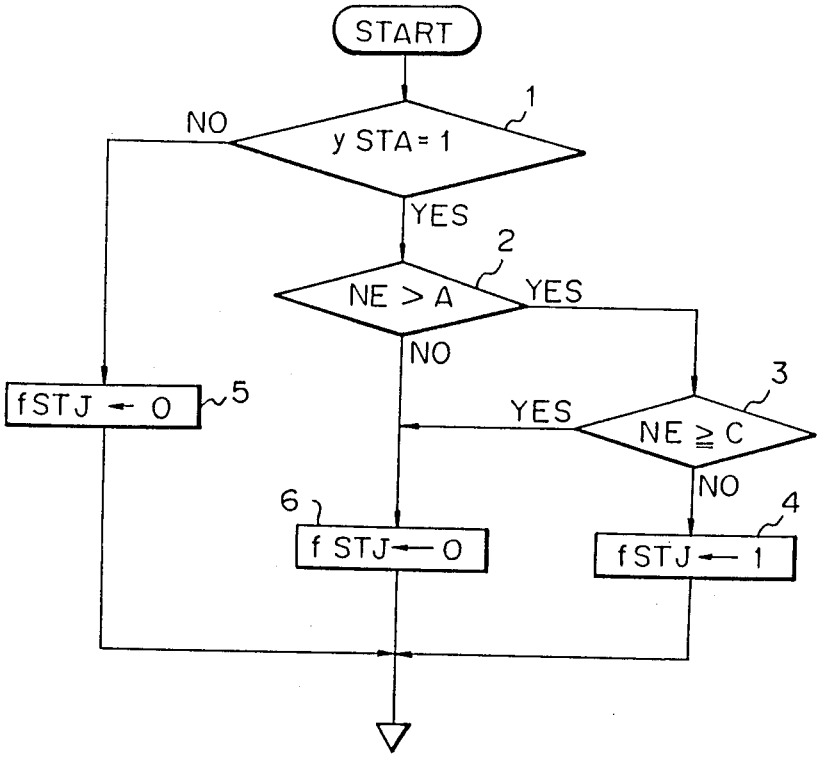
FIG. 17 is a flow chart of control of another embodiment of the present invention.

FIG. 17 is a flow chart of control of another embodiment of a fuel injection control system according to the present invention, wherein, unlike the flow chart of FIG. 16, control of the cold start injection valve is performed based on the engine rotational speed and not the engine cooling water temperature THW. Referring to FIG. 17, first it is judged if the starter switch is ON or OFF through judgement as to whether a starter signal (ySTA) has arrived (step 1). When no starter signal has arrived, the cold start injection valve operation flag FSTJ is made 0 and the cold start injection valve is not operated (step 5). When the starter signal has arrived and cranking has begun, it is judged if the engine rotational speed NE is above a first set value A (for example, 100 rpm) (step 2). If the speed NE is above A, next it is judged if it is above a second set value C (for example, 400 rpm) (step 3). If the speed NE is below C, the cold start injection valve operation flag FSTJ is made 1 and the cold start injection valve begins operation (step 4). On the other hand, if the speed NE is less than A or more than C, FSTJ is made 0 and the operation of the cold start injection valve is stopped (step 6). Here, the set values A and C are such that $A<C$. As clear from the above explanation, when the starter switch is on, the cold start injection valve is operated within the range of predetermined set values, that is $A<NE<C$. That is, control is effected to achieve the cold start injection valve drive time J shown in FIG. 14.

Figure 18:
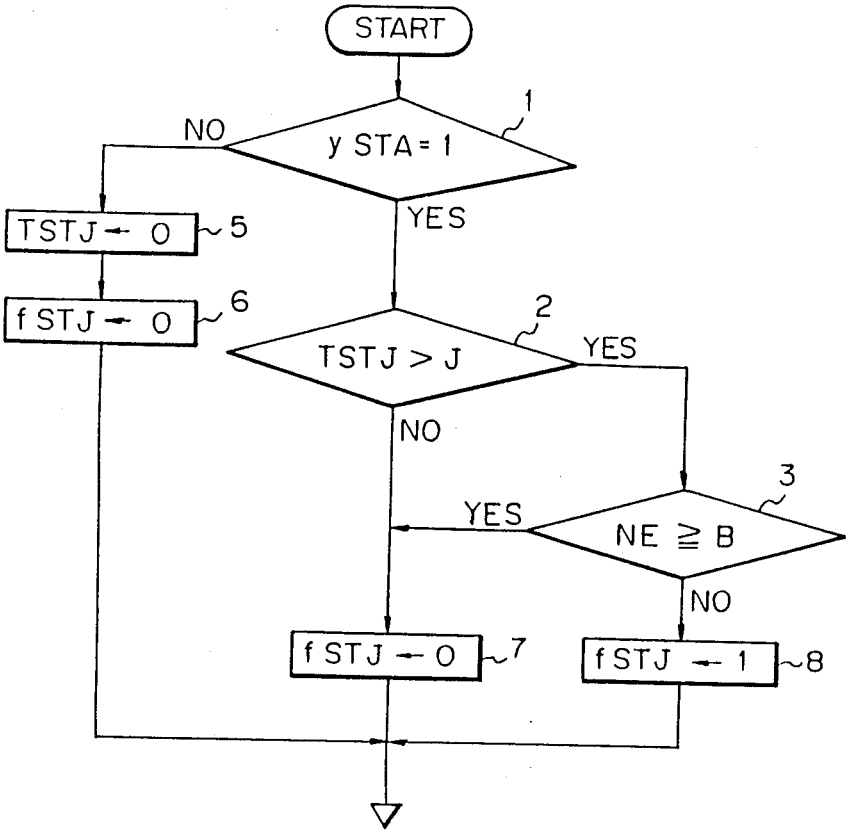
FIG. 18 is a flow chart of control of still another embodiment of the present invention.

FIG. 18 is a flow chart of control of still another embodiment of a fuel injection control system according to the present invention, wherein control is effected based on the time elapsed after the starter switch in turned on and based on the engine rotational speed. Referring to FIG. 18, first it is judged if the starter switch in ON or OFF through judgement as to whether a starter signal (ySTA) has arrived (step 1). When the starter signal has arrived and cranking has begun, a timer, for measurement of the cold start injection valve operation time, begins to count and it is judged if the flag TSTJ, indicating the count, is greater than a predetermined a elapsed time J (for example, 100 msec) (step 2). If TSTJ is greater than J, it is next judged if the engine rotational speed NE is greater than B (step 3). If NE is less than B, the cold start injection valve operation flag fSTJ is made 1 and the cold start injection valve begins operation (step 8). Further, if TSTJ is less than J or NE is more than B, fSTJ is made 0 and the operation of the cold start injection valve is stopped (step 7). On the other hand, if no starter signal has arrived at step 1, the RAM of the counter which measures the cold start injection valve operation time is cleared (step 5) and the flag operating the cold start injection valve is cleared (step 6).

Figure 19:
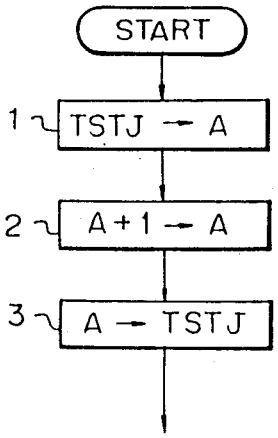
FIG. 19 is a flow chart of calculation of a counter used in the control flow of FIG. 18.

FIG. 19 is a flow chart of the count of the counter in the control routine of FIG. 18. The counter counts up every 4 msec. It begins the count when the starter switch is turned on and enters the content of the TSTJ in an A register (step 1). Next, it enters the content A+1 into the A register (step 2). It then enters the content of the A register into the TSTJ (step 3).

Figure 20:
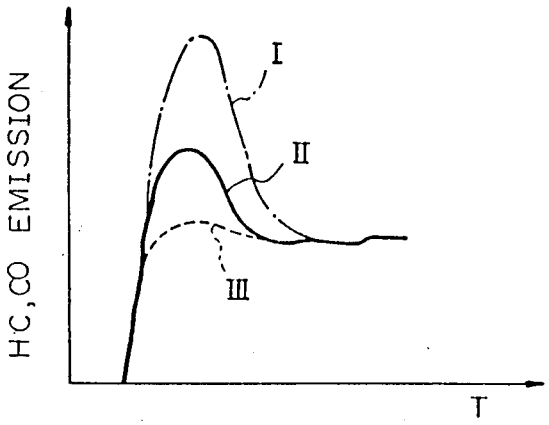
FIG. 20 is a graph of the effectiveness of the present invention.

FIG. 20 is a graph of the effectiveness of the present invention. With the conventional cold start injection valve drive time pattern shown in FIG. 2 when the set temperature of the time switch is made $T_2$, excess fuel causes emission of hydrocarbons and carbon monoxide such as shown by curve I. Further, in the prior art method, the cold start injection value was driven at the same time as the starter switch was turned on, so emission deteriorated as shown by curve I. Further, in the prior art, when the set temperature was made $T_2$, the cold start injection valve would be driven for the maximum drive time of the time switch even after the engine completed its startup so long as the starter switch was on, whereby a large amount of excess fuel would be injected and curve A given. Further, in the prior art method, when the operating temperature was made $T_1$, the cold start injection valve would not operate at temperatures above it and curve III would be given.

On the other hand, in the drive of the cold start injection valve according to the present invention, the engine rotational speed is used to monitor the completion of startup by the engine. Even when the starter switch is on, if it is judged that startup is completed, as shown by C3 to C4 to FIG. 13, the drive of the cold start injection valve is immediately terminated, so no excess fuel is injected. In this case, since an upper limit is placed on the drive time of the cold start injection valve as shown by FIG. 13, the emission of hydrocarbons and carbon monoxide become as shown by curve II. On the other hand, as shown by FIG. 14, the engine rotational speed after the starter switch is turned on, or the time elapsed, is monitored and the cold start injection valve driven after the delay of a predetermined time, so adhesion of fuel to the walls of the intake system is prevented and curve II obtained for improved emission. In this way, the emission of hydrocarbons and carbon monoxide becomes I>II>III. Curve III is the case where the cold start injection valve is not driven. Considering the starting characteristics, the present invention, which gives the curve II, is the most advantageous.

We claim:

1. A fuel injection control system for an internal combustion engine comprising:

a cold start injection valve provided inside an intake pipe for performing fuel injection on cold starts;

a switch means for controlling energization of the cold start injection valve;

a starter drive state detection means for judging if a starter is being driven;

a clock means for detecting, by the starter drive state detection means, a change of the starter from a nonoperating state to an operating state and for counting time elapsed from said detected change; and a start control means which designates a starting fuel injection when the elapsed time counted by the clock means is a first predetermined period or more and which prohibits the starting fuel injection when the elapsed time is a second predetermined period or more greater than the first predetermined period.

2. A fuel injection control system as claimed in claim 1, wherein said switch means includes a first control switch of a bimetal type whose contacts open and close through heat generated from a heat coil and a second control switch whose contacts open and close through energization.

3. A fuel injection control system as claimed in claim 1, wherein said switch means comprises just a switch whose contacts open and close through energization.

4. A fuel injection control system as claimed in claim 1, wherein said clock means includes a counter.

5. A fuel injection control system as claimed in claim 1, wherein said start control means includes an engine cooling water temperature detection means and an engine rotational speed detection means.

6. A fuel injection control system as claimed in claim 1, wherein said start control means includes an elapsed time detection means and an engine rotational speed detection means.

7. A fuel injection control system as claimed in claim 1, wherein said start control means includes a delay circuit comprised of a resistor and capacitor.

8. A fuel injection control method for controlling fuel injection timing of a cold start injection valve of an internal combustion engine, characterized by:

providing a control switch for controlling operation of said cold start injection valve and a control means for controlling an ON/OFF state of the control switch;

based on commands of said control means, turning said control switch on after the elapse of a first predetermined time from when a starter switch is turned on so as to open said cold start injection valve and start the fuel injection; and turning said control switch off after a second predetermined time greater than said first predetermined time so as to close said cold start injection valve and stop the fuel injection.

9. A fuel injection control method for controlling a fuel injection timing of a cold start injection valve of an internal combustion engine, characterized by:

providing a control switch for controlling operation of said cold start injection valve and a control means for controlling an ON/OFF state of the control switch and based on commands of said control means, turning said control switch on after the elapse of a first predetermined time from when a starter switch is turned on so as to open said cold start injection valve and start the fuel injection.

10. A fuel injection control method as claimed in claim 8 or 9, wherein said control means includes a starter drive state detection means for detecting a drive state of a starter, an elapsed time detection means for detecting the ON time of a starter switch, and an engine rotational speed detection means for detecting the engine rotational speed.

11. A fuel injection control method as claimed in claim 8 or 9, wherein said control means includes a starter drive state detection means for detecting a drive state of a starter, an engine cooling water temperature detection means for detecting the engine cooling water temperature, and an engine rotational speed detection means for detecting the engine rotational speed.

12. A fuel injection control method as claimed in claim 8 or 9, wherein said control switch includes a first control switch having a bimetal and a second control switch using a solenoid coil.

13. A fuel injection control method as claimed in claim 8 or 9, wherein said control switch includes just a control switch using a solenoid coil.

* * * * *